US006390697B1

(12) United States Patent
O'Mera et al.

(10) Patent No.: US 6,390,697 B1
(45) Date of Patent: May 21, 2002

(54) PRINTHEAD MOUNTING GUIDE FRAME

(75) Inventors: Neil E. O'Mera, Woodbury; James R. Meier, St. Paul, both of MN (US)

(73) Assignee: Fargo Electronics, Inc., Eden Prairie, MN (US)

( * ) Notice: Subject to any disclaimer, the term of this patent is extended or adjusted under 35 U.S.C. 154(b) by 0 days.

(21) Appl. No.: 09/430,712

(22) Filed: Oct. 29, 1999

(51) Int. Cl.[7] ..... B41J 2/00
(52) U.S. Cl. ..... 400/120.16; 400/693; 347/197
(58) Field of Search ..... 400/120.16, 120.17, 400/120.01, 175, 691, 692, 693; 347/197, 198, 222; 269/50, 51, 55, 56, 287, 289 R, 309, 310

(56) References Cited

U.S. PATENT DOCUMENTS 4,953,994 A * 9/1990 Shiozaki et al. ..... 400/120
5,156,477 A * 10/1992 Hasegawa ..... 400/649
5,366,302 A * 11/1994 Masumura et al. .... 400/120.16
5,672,020 A * 9/1997 Leonard et al. ..... 400/690.4
5,694,159 A * 12/1997 Kajiya et al. ..... 347/197
5,825,392 A * 10/1998 Mochizuki ..... 347/197

* cited by examiner

*Primary Examiner*—Ren Yan
(74) *Attorney, Agent, or Firm*—Westman, Champlin & Kelly, P.A.

(57) ABSTRACT

A thermal printer has a thermal printhead mounted on a pivot frame which is movable from a working position where the printhead is in position to print from a thermal ribbon onto a substrate, to an open position which permits access to ribbon take-up and supply rolls. The printhead is pivotally mounted to the pivot frame, and its pivoting is controlled by a cam so that the sensitive thermal print element of the thermal printhead remain at a position that permits access to the ribbon and other printer working components, without exposing the print elements so they can easily be contacted by a person servicing the printer. Cooperating guide members are used for controlling the orientation of the printhead as the pivot frame moves between a working position and an open position.

20 Claims, 8 Drawing Sheets

PRINTHEAD MOUNTING GUIDE FRAME

CROSS REFERENCE TO RELATED APPLICATION

Reference is made to application Ser. No. 09/430,714, filed on even date herewith for PRINTHEAD ALIGNMENT DEVICE AND METHOD OF USE, now U.S. Pat. No. 6,298,783B1), owned by the same assignee as this application and incorporated by reference.

BACKGROUND OF THE INVENTION

The present invention relates to a mounting frame for a printhead, specifically a thermal printhead, used with a thermal transfer ribbon or such as a dye sublimation ribbon, which has exposed, sensitive heat elements or resistive elements along a print line that engage a ribbon for printing on a substrate supported on a platen. The printhead is on a frame so it can be pivoted away from its working position to provide access to ribbon take-up and supply rolls and is guided so that the print line of heat elements remains oriented to shield the elements when the printhead is raised.

Prior art thermal printers have printheads mounted on frames and pivoted between a working position and an open position where the ribbon and other interior printer components are accessible. However, the housings or supports for the printheads presently are fixed to a pivoting frame so that when the printhead is in its working position it is substantially vertical, and facing the interior of the printer, and when the frame is pivoted 90° to its open position, the pivot head is substantially horizontal. The sensitive heater resistive elements overlie the region in which an operator must work to replace a ribbon and are exposed so they can be contacted by the operator. This exposure creates the potential for the printer resistive elements to be bumped and damaged by jewelry, tools or other hard objects the user might employ.

The printheads are expensive, and if the thermal elements are damaged the printhead has to be replaced. Access to the ribbon take-up and supply rollers is necessary, and the present invention provides a mounting guide for the printhead so that the printhead remains vertically oriented and the resistive elements are out of the way or shielded from impacts and contact with the operator when the printhead is raised to its open position.

SUMMARY OF THE INVENTION

The present invention relates to a printhead mounting, particularly for thermal printheads that have heater resistive elements along the print line, which guides the printhead as it is moved to an open position for permitting access to the ribbon supply and other components of the printer. The printhead is pivotally mounted to a pivot frame and as the pivot frame is moved, the printhead is guided with a guide shaft moving in a cam track so that the printhead remains oriented with the print line heater resistive elements facing toward the interior of the printer. The resistive elements face in a direction so they are shielded by the printhead body throughout the path of travel between the printhead working position and an open position. The printhead is also positively guided with the guide shaft as the head is returned to working position. The guide shaft prevents the head from moving independently and hitting the rear wall of the printer. The printhead is spring-loaded to keep it oriented properly.

The printhead has a mounting frame, with side plates on the sides of the printhead for adjustably mounting the printhead relative to the pivot frame. The frame side plates can be precisely adjusted during assembly and the printhead fixed in place so that the print line on the printhead is properly located on a support platen when in a working position to allow for optimized print location and for the head to be movable at the same time.

The printhead operates in a conventional manner for thermal printers, and is adapted to be used with standard mountings for the platen, and with existing ribbon supply and take-up rollers. The pivot mounting of the printhead relative on the pivoting frame is possible because the printhead is guided in guide tracks as tracks as it approaches its working position. Then as the printhead is closed, the printhead moves into a guide that causes the same precise location as it had each time it was closed. Having the printhead positioned out of the way of the work area when the printhead is in its open position not only protects the resistive elements, but also makes the interior of the printer more accessible.

DETAILED DESCRIPTION OF THE ILLUSTRATIVE EMBODIMENTS

A printer assembly illustrated generally at 10 uses conventional dye subthermal printing techniques. It is shown schematically shown insofar as the printer frame or housing 12 is concerned, and many of the components are not shown for sake of clarity, such as the substrate or card feed arrangement for printing, and laminators or other parts that are used for processing identification cards. These components can be standard parts of a thermal printer.

Figure 4:
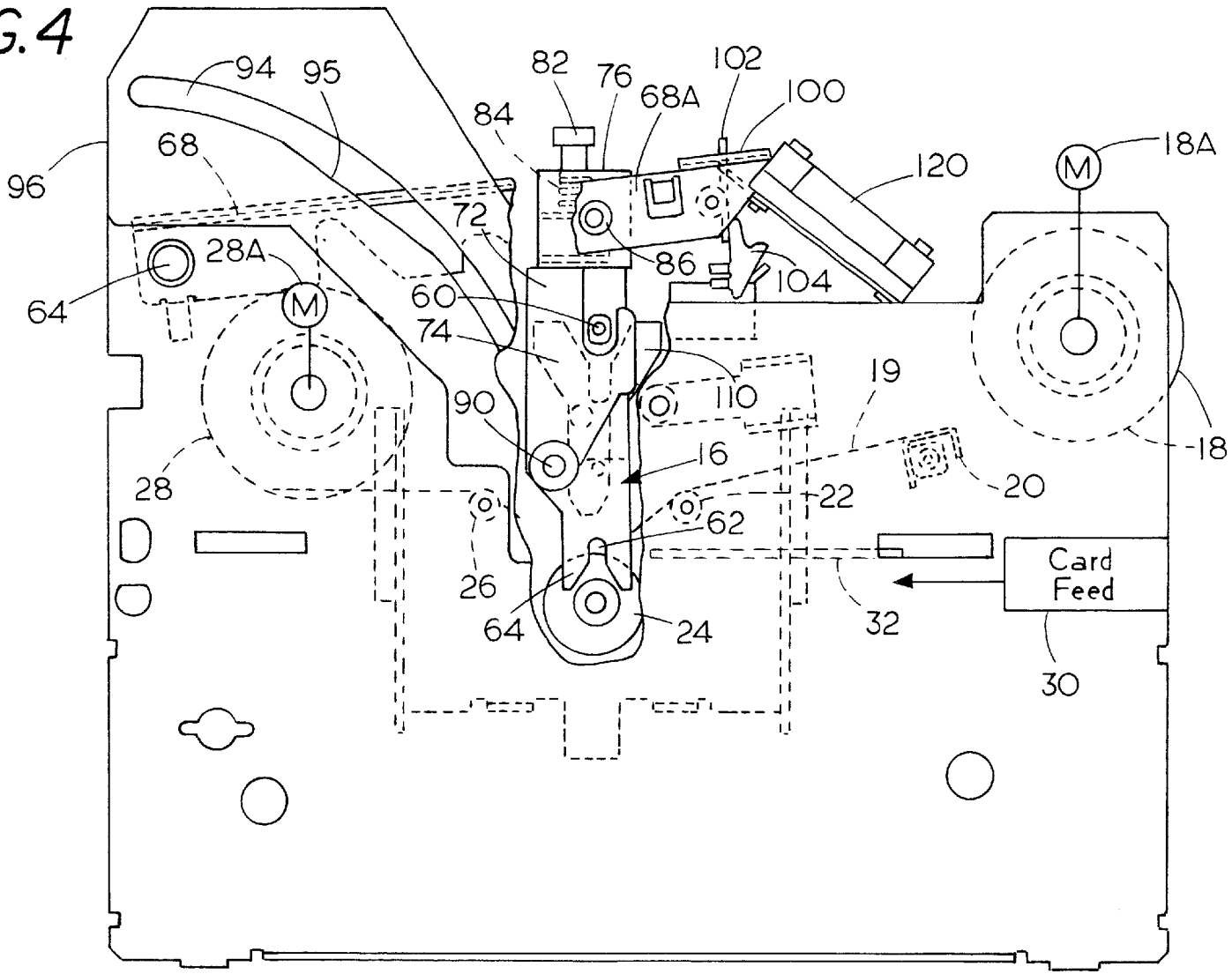
FIG. 4 is a side elevational view thereof showing the printhead in a working position with parts in section and parts broken away.
Figure 5:
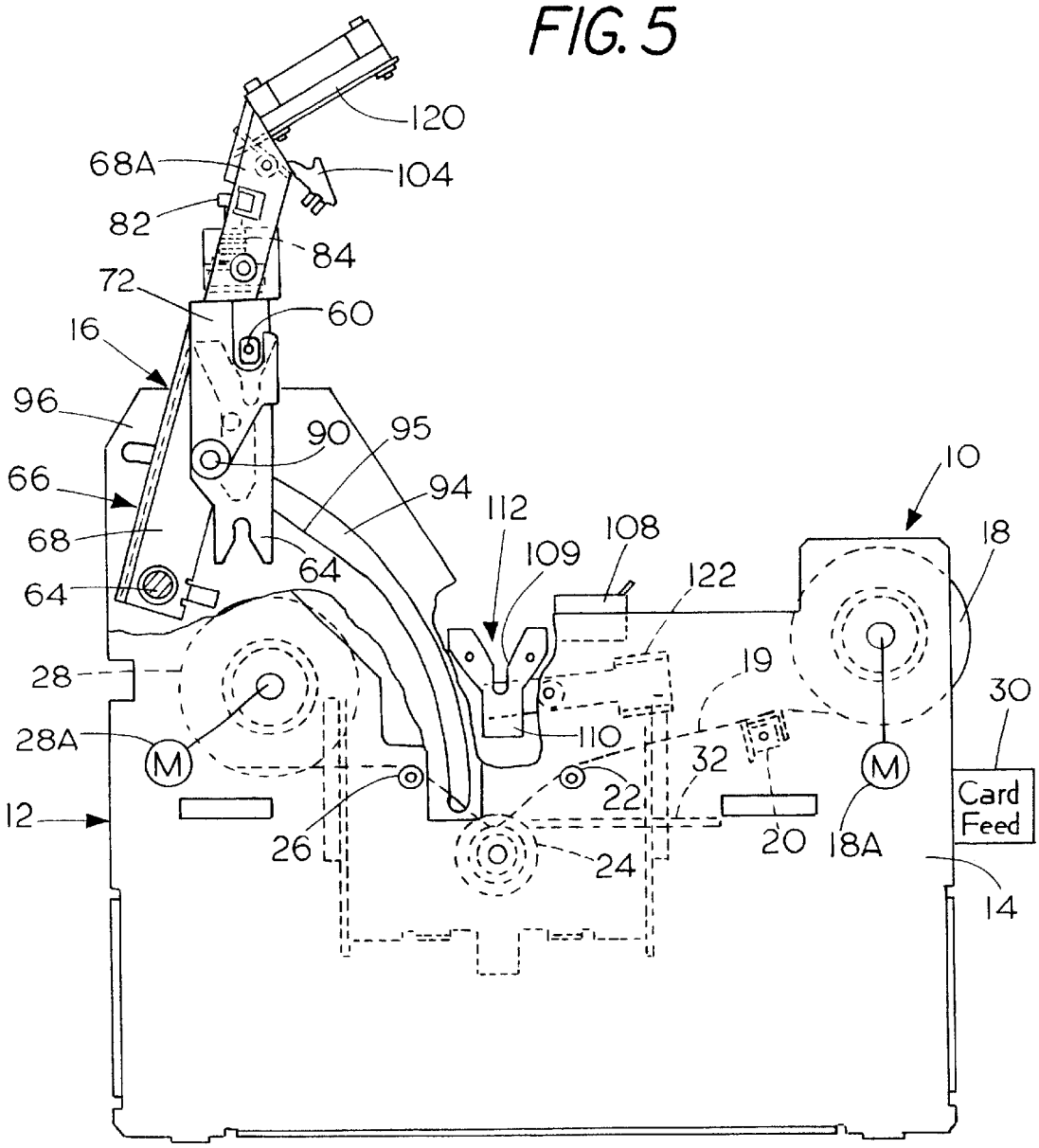
FIG. 5 is a side elevational view showing the printhead in a fully raised position with parts in section and parts broken away.

The printer frame 12 includes side plates or members 14, 14 that are spaced apart, and the major components of the printer are positioned between the side plates. The printer construction, except for the printhead mounting is the same as the printer sold by Fargo Electronics, Inc. of Eden Prairie, Minn. under the trademark DTC600. The printer is a thermal printer that has a printhead assembly indicated generally at 16 that will print on a dye sublimation ribbon, or a thermal transfer resin ribbon 19 that extends from a supply roll 18. As can be seen in FIG. 4 for example, the ribbon 19 is passed over a suitable sensor 20, and guided by a guide roller 22 underneath the printhead assembly 16, and above a print platen 24, and then across a second guide roller 26 to a ribbon take-up roll 28 of conventional design. A card or substrate feed 30 is shown only schematically, since it is conventional. The card feed 30 moves an identification card 32, or other substrate, to a position shown schematically in FIG. 4 to pass under the ribbon 19, and thus under the printhead 16 and above the platen 24.

Printing is carried out in a normal manner, and the print ribbon 19 can be moved back and forth by driving the supply and take-up rollers with stepper motors 18A and 28A as the printhead is raised and lowered slightly for permitting the ribbon to pass underneath.

Figure 6:
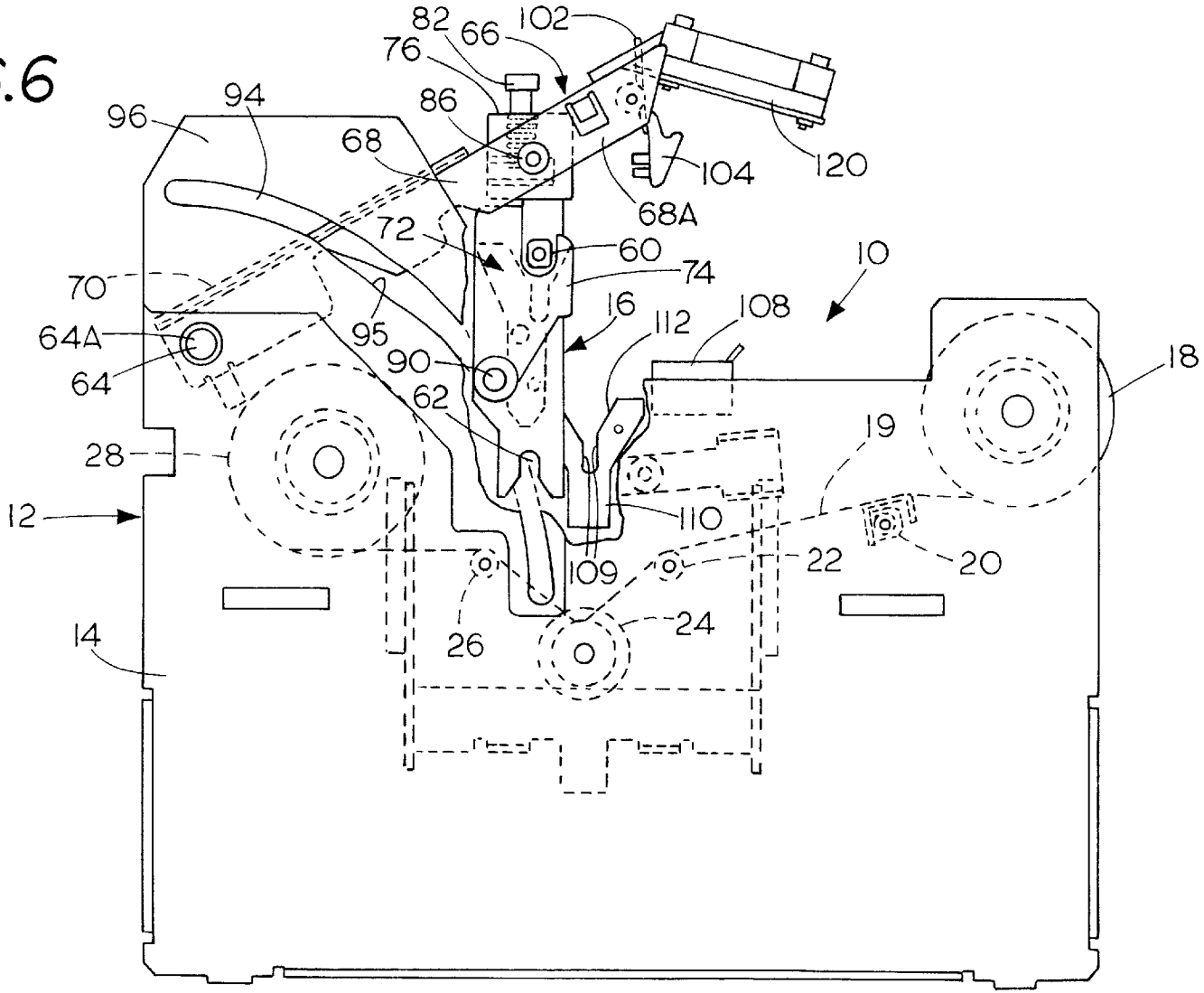
FIG. 6 is a fragmentary side elevational view showing the printhead in a partially raised position with parts broken away.
Figure 7:
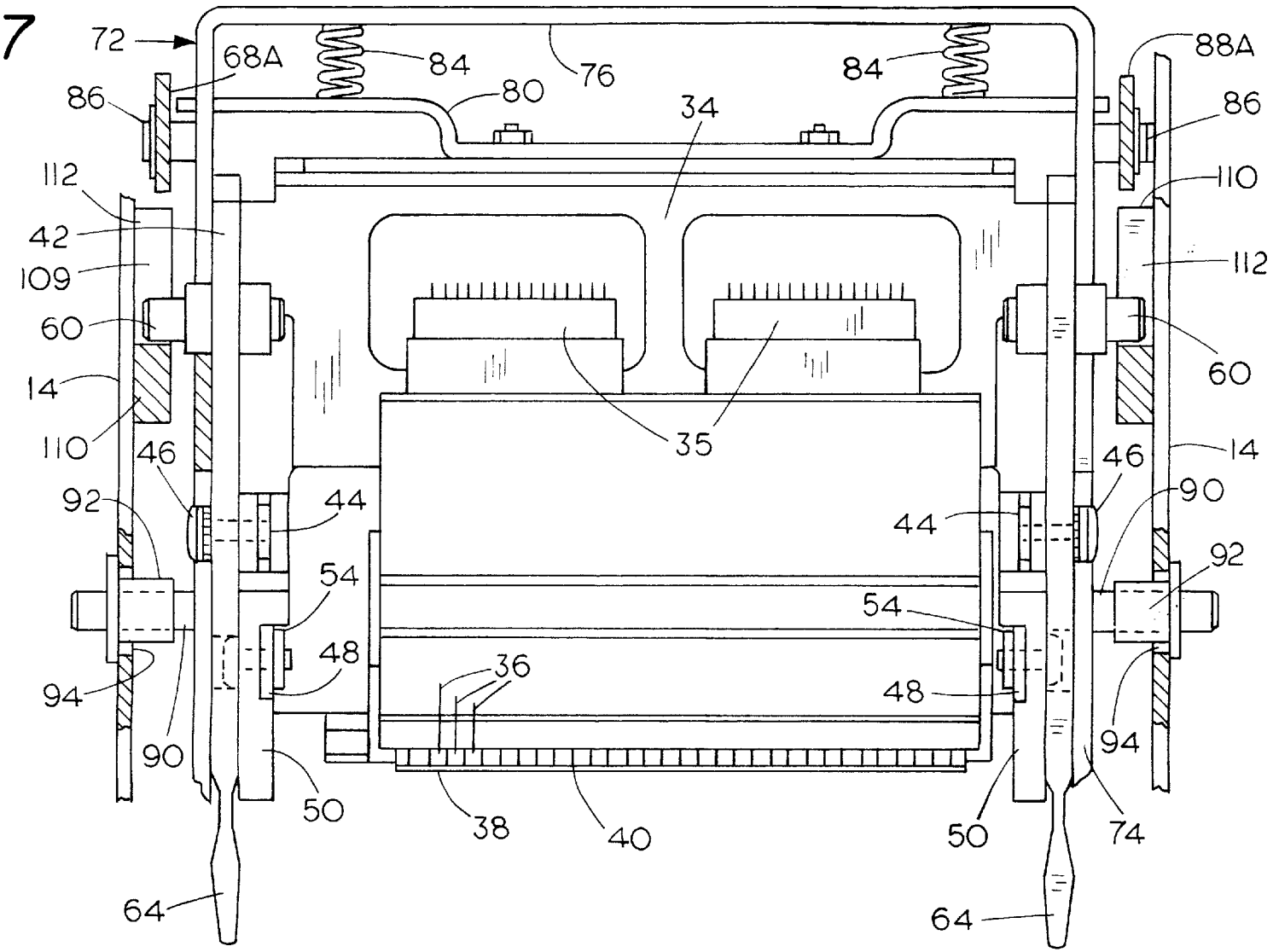
FIG. 7 is a front elevational view of the printhead and cam assembly with the side plates of the printer shown schematically in section.

The printhead assembly 16, as seen in FIG. 7 for example, includes a printhead support frame 34 that mounts suitable components, including connectors 31 for carrying power for energizing individual resistance heaters that are shown schematically at 36. The resistance heaters heat individual resistive elements 38 forming an exposed print line facing the platen 24 (FIG. 6) when in a working position along a print line frame 40 of the printhead. Support frame 34 is mounted on side supports 42 that are adjustably fixed relative to the support frame 34.

The printhead is aligned relative to supports 42 in a separate bench mounted fixture and then locked in place, so the printhead will be accurately positioned when guided in place with the pivoting support. The ii alignment is explained in greater detail in application Ser. No. 09/430, 714 filed on even date herewith for PRINTHEAD ALIGNMENT DEVICE AND METHOD OF USE.

Figure 8:
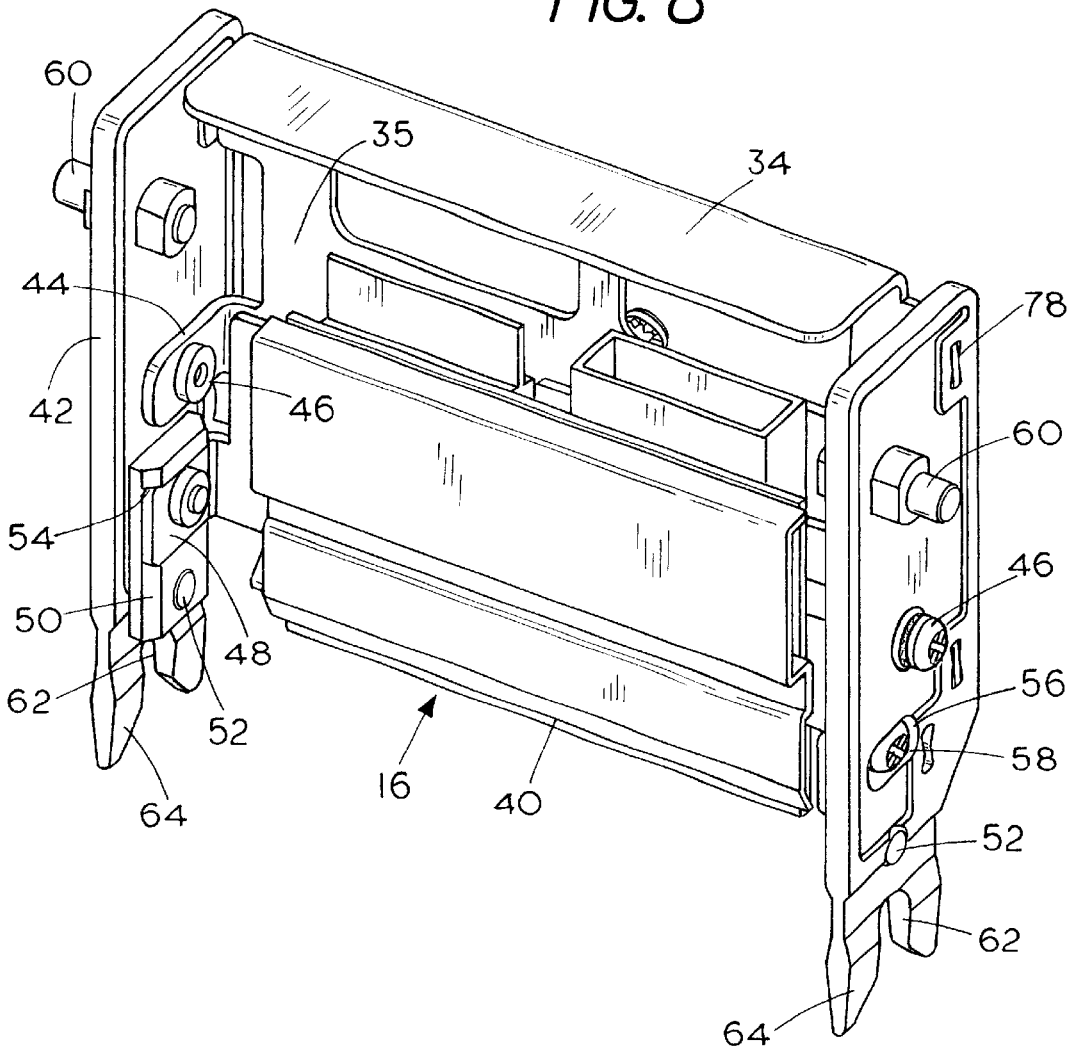
FIG. 8 is a perspective view of the printhead illustrating the side frame mounts for the printhead that permit adjustment for aligning the print line correctly in the printhead frame.

Briefly, as can be seen in FIG. 8 in a perspective view, the printhead support frame 34 has integral bent tabs 44 along the sides (both sides are the same) which are held with screws 46 to the side supports 42. The support frame 34 has second bent tabs 48 formed on the sides thereof, spaced from the tabs 44. The tabs 44 and 48 are both integral with the main cross member 35 of the frame 34. Tab 48 on each side is mounted in a slot or recess 54 of an associated adjustment block 50. The blocks 50 are mounted on each of the side supports 42 and the blocks can pivot on pivot dowel pins 52, which are accurately formed.

The side supports 42 each have a slot aperture 56 through which a screw 58 passes. The screws 58 thread into openings of the aligned tabs 48. The tabs 48 can slide transversely in the slots 54 and the blocks 50 can be adjustably pivoted about pins 52 to permit alignment of the print line of the print line relative to the alignment guide forks 64 at the lower end of the side supports 42 and guide pins 60. Once the print line frame 40 is properly located so that it is in proper position with respect to the guide pins 60 and the guide slots or receptacles 62 in the lower fork members 64, screws 58 can be tightened, on each side of the printhead support frame 34. The print line frame 40 will be positively aligned relative to the mounting points of side supports 42.

The guide pins 60 are studs that are fixed to the side supports 42, and they are used for alignment of the printhead relative to the platen of the printer when the printhead is mounted on its supporting swing frame shown at 72 and moved from open position to working or printing position.

Figure 1:
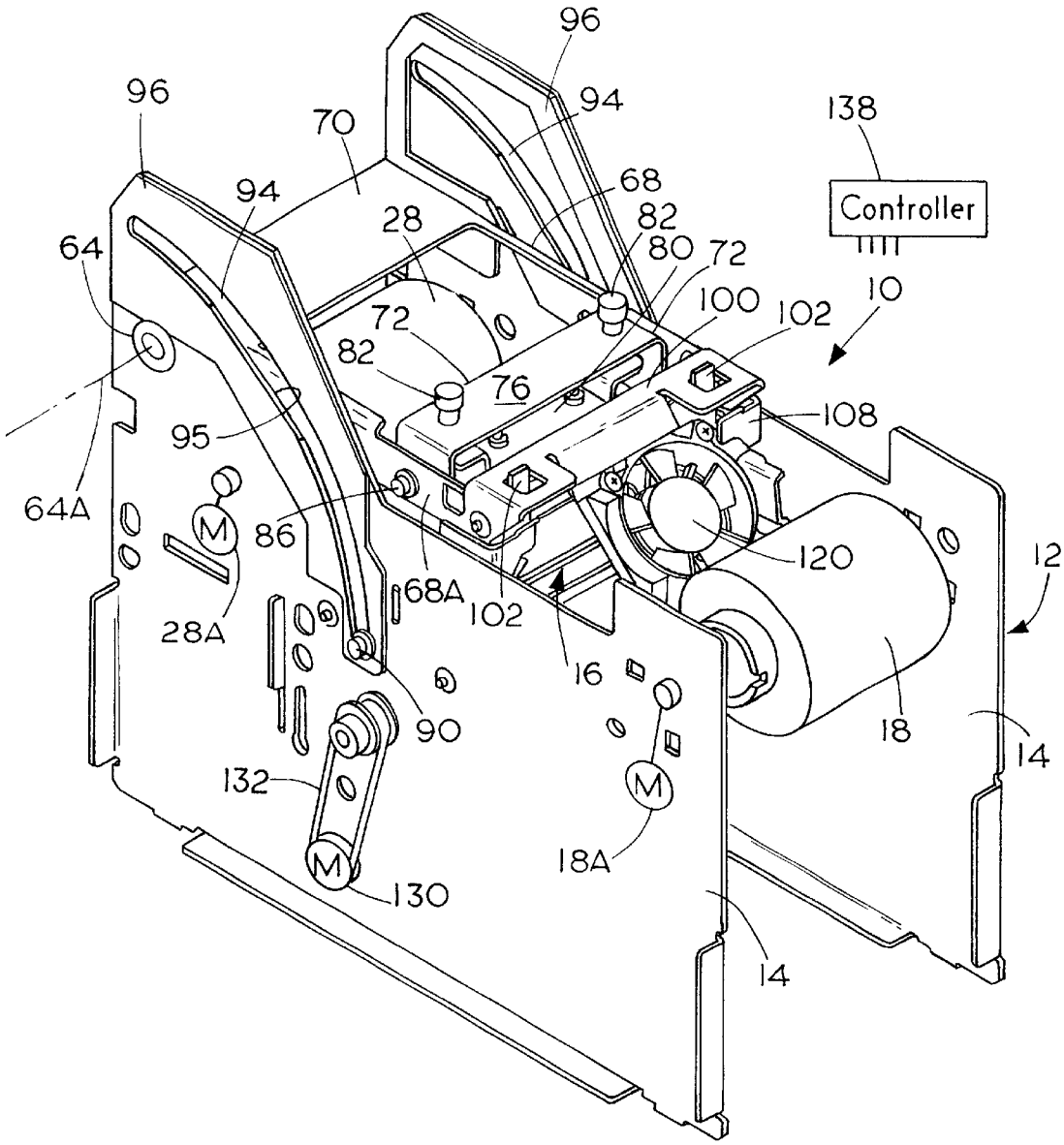
FIG. 1 is a front perspective view of a printer having a printhead mounted according to the present invention.
Figure 2:
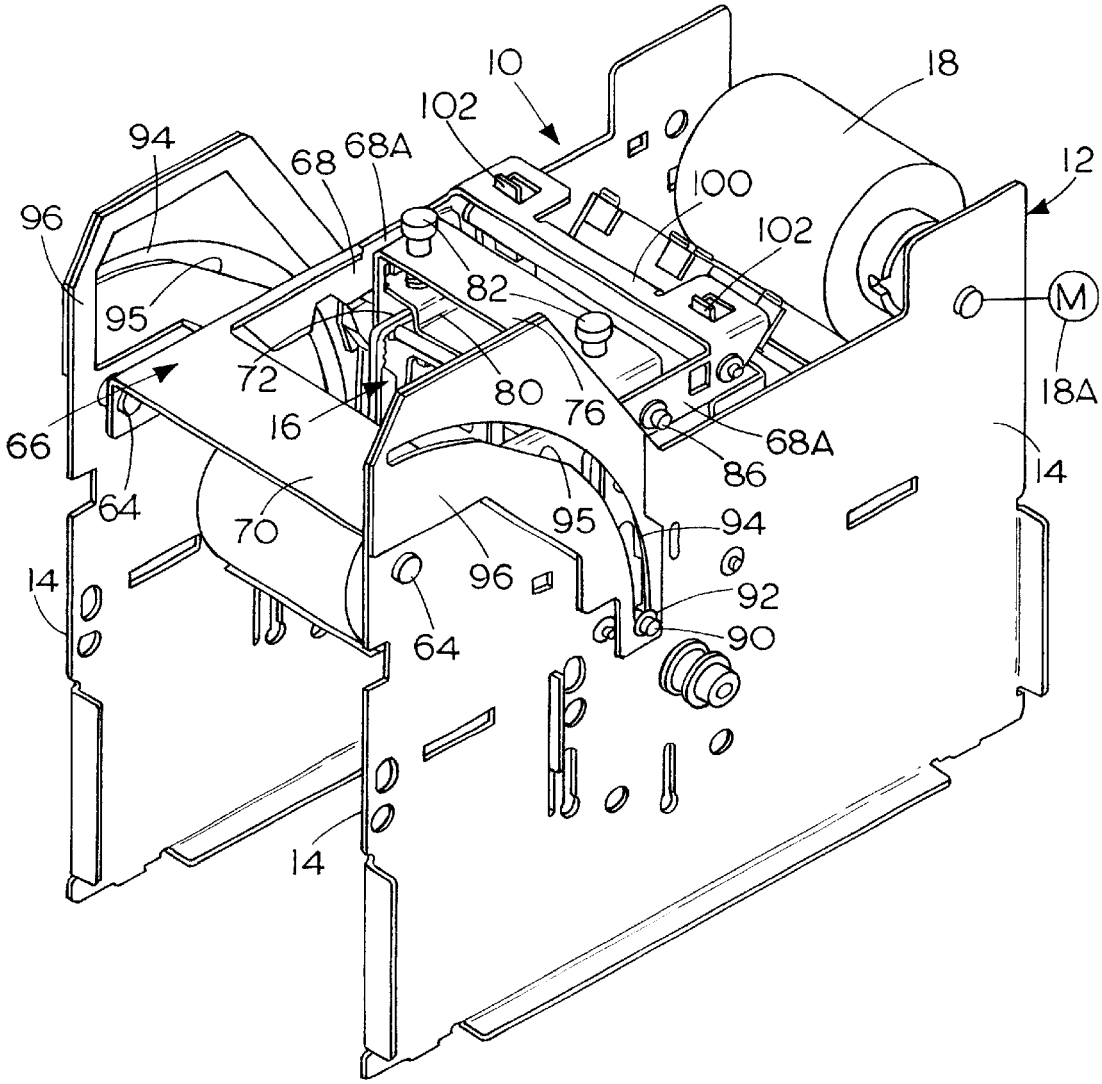
FIG. 2 is a rear perspective view of the printer of FIG. 1.
Figure 3:
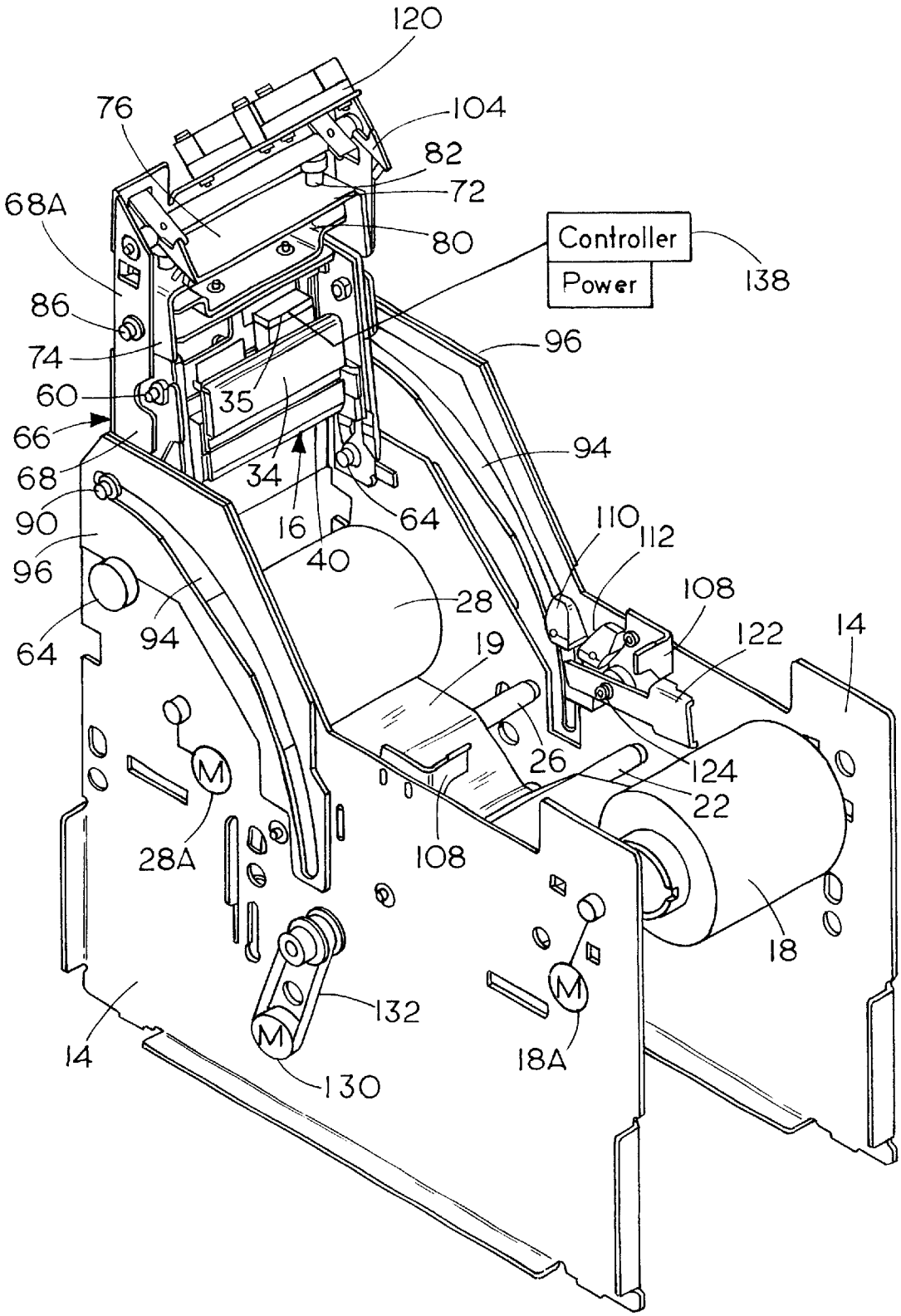
FIG. 3 is a front perspective view of the printer of FIG. 1 showing the printhead in a raised or open position.

As shown in FIGS. 1, 2 and 3, the printer frame or housing side plates 14 support pivot pins 64 that pivotally mount a printer head pivot frame 66. The printer head pivot frame 66 is a unitary frame that has a pair of side members or legs 68, and these are joined by a base cross member 70. The side legs 68 extend forwardly from the cross member 70, and pivotally mount a printhead swing frame 72 that supports the printer assembly 16 relative to the forward end 68A of the pivot frame members or side legs 68.

The swing frame 72 has side legs 74 that extend along the side supports 42, and has a cross member 76 that is positioned above the printhead assembly 16. The swing frame 72 mounts the printhead assembly 16 by spring loading the studs into slots 78 on the side legs 74. The printhead assembly 16 has a cross plate 80 mounted to its top wall, which is spring loaded downwardly relative to the cross member 76, using guide pins 82 and springs 84 to bear on the cross plate 80 to provide a spring load, not only to hold the printhead in slots 78 but also to spring load the print line frame 40 against the ribbon 19 and platen 24 when the printhead is in working position.

The side legs or plates 74 of the swing frame 72 carry pivot pins 86 that are pivotally mounted on the forward portions 68A of the side members or legs 68 of the pivot frame 66. The axes of pivot pins 86 form a pivot axis parallel to the print line on print line frame 40 of the printhead 16. The side members 74 of swing frame 70 also carry cam follower pins 90 at a lower portion of the side members 74. The cam follower pins 90 have suitable low friction bushings 92 thereon that ride in an arcuate or part circular cam track or slot 94 formed in side plate extensions 96 which are part of the side frame members 14. The center line of the cam track 94 is on a radius from the pivot frame pivot axis 64A. Also, a short flattening of the lower edge of the cam track 94 in the region shown at 95, permit some movement of the printhead in that position of its travel.

A latch bar 100 is provided between the forward ends 68A of the legs 68 of the pivot frame 66, and it carries a pair of spring loaded latches 102 on opposite sides thereof that have hooks 104 (see FIG. 6) that will fit under latch tabs 108 (see FIG. 3) and snap into place when the printhead 16 is moved to its working position against the ribbon and the platen. The latches 102 have manual tabs that extend above the cross bar 100 as shown in FIG. 2, so that the latches can be manually released when replacement of the ribbon 19 is to take place, or some other adjustment or service is needed on the interior of the printer, in regions that may be covered by the printhead.

The side frame plates 14 have V-shaped, precisely located guide members 110 mounted thereon on the interior. The guide members 110 are aligned with the position of the shaft 25 of the platen 24. When the printhead assembly 16 is in its working position, the guide pins 60, which protrude out beyond the side members 74 of the swing, frame, will enter the V-shaped entry throats 112 of the guides 110 and will fit closely between the spaced vertical surfaces 109 of the guides 110 to properly position the printhead and the print line frame 40 relative to the platen. Additionally, the forks 64 and the receptacle 62 formed thereby will fit over the shaft 25 of the platen for proper positioning. The printhead is operated in the normal manner, and the controls and the like are not shown.

When the printer is to be serviced, the latches 102 can be released, and the pivot frame 66 swung upwardly, for example to the position shown in FIG. 6 initially, and then to the full open position shown in FIG. 3. It should be noted that a fan 120 is illustrated as being carried by the pivot frame, and this fan 120 is used for providing a cooling of the printer components. The fan is powered in a suitable manner.

As the pivot frame 66 is raised, it can be seen that the center of the arcuate cam track 94 is at the axis of the pivot pin 64, so the bushing 92 rides in the cam track, and as it does so, it maintains the lower end of the swing frame 70, and thus the lower end of the printhead 16 and specifically the print line frame 40 directed downwardly. The plane of the printhead 16 stays substantially vertical throughout its travel between its working position and its fully raised position in FIG. 3. It can be seen that in the raised position, shown in FIG. 3, the pivot frame 66 will be vertical and the swing frame will remain vertically oriented. The position is controlled by the cam track 94 and the cam follower 90 carrying the bushing 92. The print resistive elements underneath the print line frame 40 remain shielded from a user's hands attempting to change ribbon by removing the take-up roll 28 and the supply roll 18 and replacing them with a new ribbon.

When the work has been done, the pivot frame 66 is moved down to the working position where the latches 102 engage the latch tabs 108 and hold the printhead securely in its working position with a suitable force that is necessary at the print line. The spring loading of the printhead 16 relative to frame 66 permits the printhead to be raised slightly during the printing operation in a normal manner or movement of the ribbon back and forth for multicolor printing.

The guides 110 on the side frames 14 positively and precisely guide the guide pins 60, which are directly connected to the side supports 42, to position the print line very precisely. The guides 110 can be adjusted for alignment. Additionally, a release lever 122 that is pivoted as at 124 (see FIG. 3) can be used for lifting up on the guide pins 60 or the supports for the adjustment pins to aid in releasing the printhead from its working position when the pivot frame is to be raised.

In a conventional printhead, there is a pivot frame similar to that shown at 66 that mounts and permits lifting the printhead, but the printhead is fixed to the frame, at the same angle relative to the pivot frame as that shown herein in working position, so that when the pivot frame is raised as shown in FIG. 3, the printhead on the prior art machine extends substantially horizontally, and the print line frame 40 and the resistive elements that are used for printing are exposed to potential damage such as by metal objects, rings, watches or the like, or just from being bumped, because the print line overlies the region where the take-up roll for the ribbon is placed.

The present mounting provides a positive shielded orientation of the printhead throughout its movement from a working position to an open position.

The printer is operated in a suitable manner, and by way of example, the platen is driven from a stepper motor 130 through a suitable belt and pulley arrangement 132 shown only schematically. Additionally, the ribbon supply and take-up rolls are driven by separate stepper motors 18A and 28A, respectively, in a normal manner. The thermal printhead also has suitable power connections for maintaining the printhead resistive elements in a heated state when desired, and all of the functions are operated from a central controller 138. The other components such as the card feed, and the transport rollers for moving the card after printing and the like are conventional, and are not shown.

The pivot frame 66 and swing frame 72, with the cam slots for orienting the printhead 16 as the pivot frame 66 moves, can be used for other working components where it is desired to move a working component from a working position out of the way, and keep a sensitive element or edge, such as print resistive elements oriented to reduce the likelihood of damage. A working component edge reference line, such as the print line of the printhead, will be precisely returned to its reference position with suitable guides, as the pivot frame moves from an open position to a working position. The control of the orientation of the working component using a cam track on the product frame and a cam follower on a subframe (swing frame) that is pivotally mounted on the pivot frame 66 insures control of the working component orientation and permits direct alignment of the working component in working position by guiding the swing frame.

Although the present invention has been described with reference to preferred embodiments, workers skilled in the art will recognize that changes may be made in form and detail without departing from the spirit and scope of the invention.

What is claimed is:

1. In a printer assembly having a printer housing, a platen mounted in the printer housing, and a printhead mounted on the printer housing, and when in a working position the printhead having a print line urged against the platen, the improvement comprising a pivot frame pivotally mounted on the printer housing and movable between an open and a working position, the printhead being pivotally mounted to the pivot frame to permit pivotal movement of the printhead relative to the pivot frame as the pivot frame moves to the open position, and a cooperating guide between the printer housing and the printhead to guide the printhead with the print line facing in substantially the same direction as the direction the print line faces when in a working position as the pivot frame is moved between the open and working positions.

2. The printer improvement of claim 1, wherein the printer housing comprises spaced printer housing side plates, said pivot frame being mounted between said printer housing side plates, said pivot frame having a pair of side members extending from a pivot axis, said printhead being pivotally mounted between the side members of the pivot frame.

3. The printer improvement of claim 2, and a cam follower mounted on the printhead, and said printer housing side plates having a cam track to guide the cam follower and to control pivoting of the printhead relative to the pivot frame as the pivot frame moves between the working position and the open position.

4. The printer improvement of claim 3 and manual latch members for holding the pivot frame in the working position.

5. The printer improvement of claim 3, wherein there is at least one guide block mounted on one of the printer housing side plates, the at least one guide block having a guide slot with a tapered entry portion therein, and a guide pin mounted on said printhead, said guide pin entering said guide slot as the pivot frame moves from the open position to the working position.

6. The printer improvement of claim 5, wherein said cam track and said cam follower permit limited relative movement there between, and said guide slot of the guide block controlling the positioning of the printhead about its pivot to the pivot frame as the pivot frame moves to the working position.

7. The printer improvement of claim 3, wherein the cam track is formed along a center line comprising a radius from the pivot axis of the pivot frame.

8. The printer improvement of claim 1, wherein said printhead is mounted in a swing frame, the swing frame having swing frame side members and a top cross member, the swing frame side members have upwardly opening slots, the cooperating guide including guide pins on the printhead received in the slots and extending outwardly from the swing frame side members for guiding relative to the printer housing, and springs acting between the top cross member of the swing frame and the printhead to urge the guide pins into the slots and spring load the printhead away from the swing frame top cross member.

9. In combination with a main frame, a support for a working component that requires alignment of a reference line and which support moves to move the working component between a working position and an open position, the support comprising a pivot frame mounted on the main frame for moving the working component between the working position and the open position, the working component being pivotally mounted on the pivot frame about a pivot axis generally parallel to a reference line of the working component, and a guide on the main frame for guiding the working component about its pivot to the pivot frame such that the working component orientation relative to the pivot frame changes as the pivot frame moves the working component to the open position from the working position.

10. The support of claim 9, wherein said pivot frame is mounted adjacent a first cam member on the main frame, and a second cam member carried with the working component to control the pivoting of the working component relative to the pivot frame as the pivot frame moves the working component between the working position and the open position, the first and second cam members comprising the guide.

11. The support of claim 9, wherein said main frame is a printer frame comprising side plates, said pivot frame being positioned between and pivoted to the side plates, and the working component comprising a printhead having a print line comprising the reference line.

12. The support of claim 11, wherein at least one of said side plates has a cam track defined therein formed along a radius centered on the pivot of the pivot frame to the side plates, and said printhead has a cam follower riding in the cam track to control the orientation of the printhead as the pivot frame is moved to move the printhead to the open position, the cam follower and cam track continuously controlling the orientation of the printhead until the printhead reaches its working position when moved from the open position, the cam track and cam follower comprising the guide.

13. The support of claim 11, and guide blocks mounted on the side plates, the guide blocks each having a slot, guide pins mounted on said printhead on sides thereof, said guide pins entering said guide slots for positioning the printhead about the pivot axis of the printhead to the pivot frame as the printhead moves from the open position to its working position.

14. The support of claim 11, wherein said printhead is a thermal printhead having a plurality of resistive elements along the print line, said resistive elements being in a position facing downwardly when the printhead is in its working position, and said resistive elements remaining oriented facing substantially in the same direction as the pivot frame moves the printhead to the open position.

15. The support of claim 9, wherein said working component is pivoted to the pivot frame through an intermediate swing frame, a pair of side supports, one attached on each side of the working component, the side supports having pivot pins forming the pivotal mounting of the working component to the pivot frame.

16. The support of claim 9, wherein the working component has a working component frame, the main frame having a pair of side supports mounting said working component frame on sides of the main frame, a pivot connection between each of the side supports and the working component frame, and a separate sliding support on each of the sides of the working component frame received in a groove on the respective side support to permit alignment of the side supports relative to the working component frame, and fasteners to secure the sliding support on the working component frame relative to the respective side support of the main frame.

17. The support of claim 16, wherein said side supports have fork members at a bottom end, said fork members forming a slot receptacle for supporting the working component relative to a shaft mounting a mating member associated with the working component.

18. A mounting for a working component supported on a main frame, wherein the working component has an edge line that requires alignment with a cooperating member on the frame and wherein the working component is movable between an open position and a working position, comprising a main frame, a pivot frame pivotally mounted on the main frame and movable to move the working component between an open position and a working position, the working component being pivotally mounted to the pivot frame to permit pivotal movement of the working component relative to the pivot frame as the pivot frame moves to move the working component to the open position, the main frame comprising spaced side members, said pivot frame being mounted between said main frame side members, said pivot frame having a pair of pivot frame side members extending from a pivot axis, said working component being pivotally mounted between the pivot frame side members, a cam follower on the working component, and at least one of said main frame side members having a cam track to guide the cam follower and to control pivoting of the working component relative to the pivot frame side member as the pivot frame moves the working component between the working position and the open position to hold the working component with the working component edge facing in substantially the same direction as the direction the edge faces when in the working position, as the pivot frame is moved.

19. The mounting of claim 18, wherein there is at least one guide block mounted on one of the main frame side members, the at least one guide block having a guide slot therein, and a guide pin mounted on said working component, said guide pin entering said guide slot as the pivot frame moves to the working position.

20. The mounting of claim 18, wherein the working component comprises a printhead, with the edge line comprising a print line, and the cooperating member comprising a platen rotatably mounted on the frame, said platen having a mounting shaft, and a guide fork mounted on the printhead and having a slot in the lower end thereof to engage and closely fit over the shaft to position the printhead when the printhead moves to its working position.

* * * * *

UNITED STATES PATENT AND TRADEMARK OFFICE

CERTIFICATE OF CORRECTION

PATENT NO. : 6,390,697 B1
DATED : May 21, 2002
INVENTOR(S) : Neil E. O'Mara

It is certified that error appears in the above-identified patent and that said Letters Patent is hereby corrected as shown below:

Title page,
Item [75], cancel "Neil E. O'Mera" and insert -- Neil E. O'Mara --.

Signed and Sealed this

Twenty-eighth Day of January, 2003

JAMES E. ROGAN
*Director of the United States Patent and Trademark Office*